US005715968A

United States Patent [19]

Fink et al.

[11] Patent Number: 5,715,968

[45] Date of Patent: Feb. 10, 1998

[54] HAND CARRIED SHOPPING BASKET

[76] Inventors: Stacey M. Fink; Karen L. Ketner-Fink, both of 1901 Shadwell Way, Lawrenceville, Ga. 30243

[21] Appl. No.: 722,911

[22] Filed: Sep. 27, 1996

[51] Int. Cl.[6] ..... B65D 25/00

[52] U.S. Cl. ..... 220/669; 220/772

[58] Field of Search ..... 220/669, 760, 220/769, 770, 772, 773, 485

[56] References Cited

U.S. PATENT DOCUMENTS

| | | | |
|---|---|---|---|
| D. 326,552 | 5/1992 | Goodell | D34/42 |
| 2,314,835 | 3/1943 | Johns et al. | 220/772 X |
| 2,549,272 | 4/1951 | Aschbrenner | 220/669 X |
| 2,844,279 | 7/1958 | Kovach | 220/110 |
| 3,039,651 | 6/1962 | Lang | 220/110 |
| 3,813,003 | 5/1974 | Bernazzani | 220/772 |
| 4,003,611 | 1/1977 | Smith | 20/773 X |
| 4,266,668 | 5/1981 | Pack | 206/557 |
| 4,673,625 | 6/1987 | McCartney et al. | 220/760 X |
| 4,720,020 | 1/1988 | Su | 220/6 |
| 4,941,586 | 7/1990 | Tarna | 220/83 |
| 5,310,079 | 5/1994 | Sandy et al. | 220/476 |
| 5,337,910 | 8/1994 | Picozza et al. | 220/769 X |

*Primary Examiner*—Steven M. Pollard
*Attorney, Agent, or Firm*—Hinkle & Associates, P.C.

[57] ABSTRACT

A hand carried shopping basket 2 is configured so that it may be carried with a shopper's arm 6 hanging closer to the shopper's body 8 with the palm facing naturally and in an anatomically-neutral position toward the body. The shopping basket has two elongated, longitudinal sides 12, two lateral sides 20 and a bottom 10. All sides are generally trapezoidally-shaped, and at least one of the longitudinal sides has a concave shape 18. Pivotally mounted to the lateral sides within a protrusion 34 and aligned generally parallel to a longitudinal axis are a pair of spaced apart, elongated handle structures 44 which combine and engage one another over the longitudinal axis. To facilitate stackability of the basket, the handles have angled pillars 52 which enable each handle to be pivoted to an exterior position and provide open access to the bottom.

18 Claims, 4 Drawing Sheets

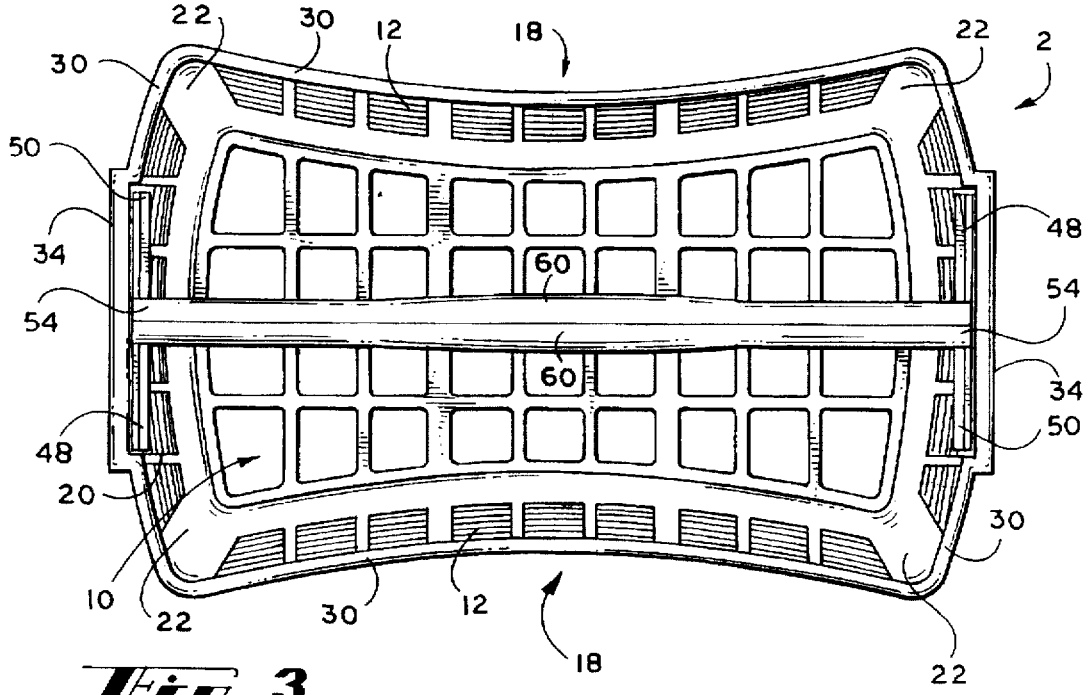
Fig_3
Fig_4
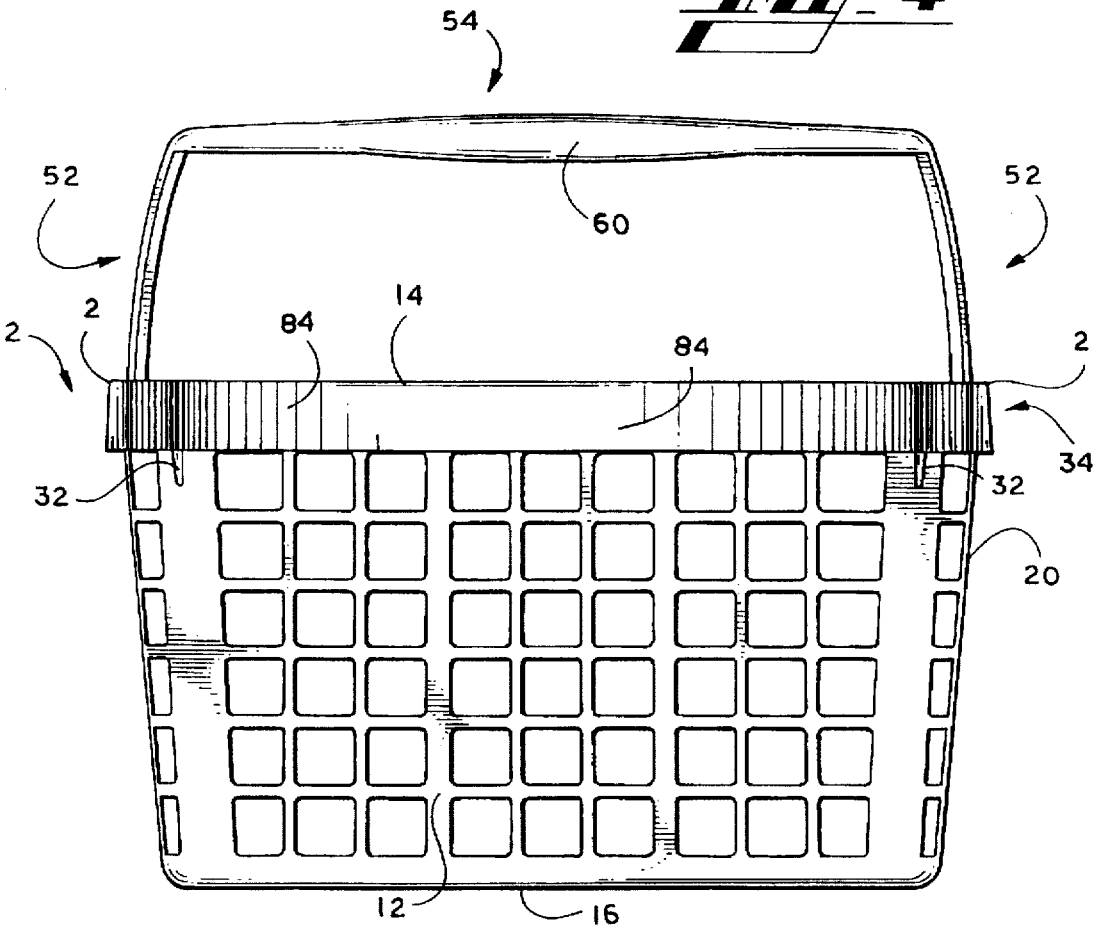

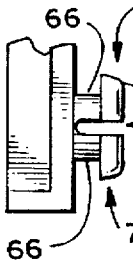
Fig_7
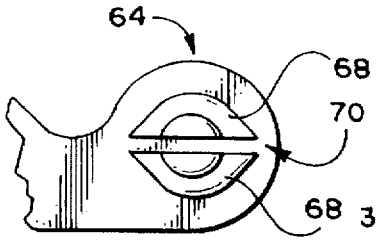
Fig_8
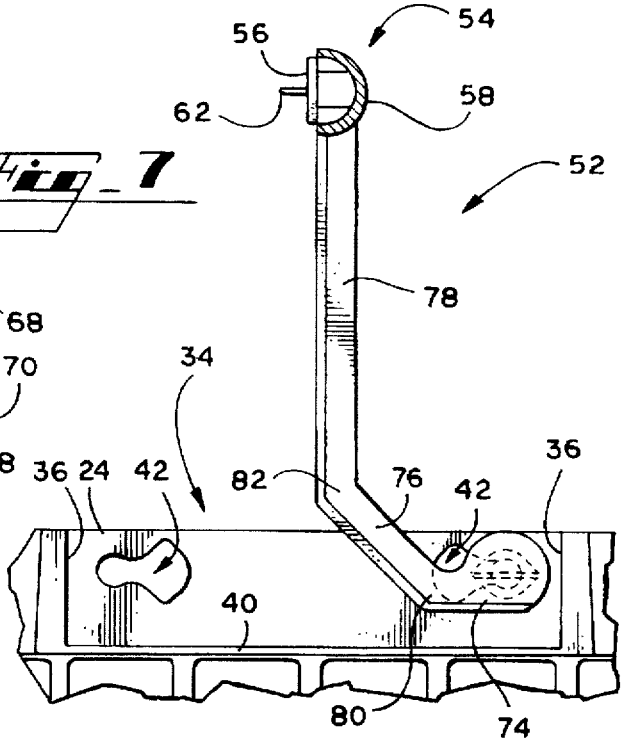
Fig_6
Fig_9
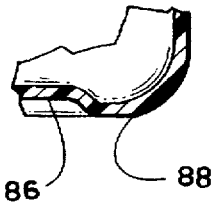
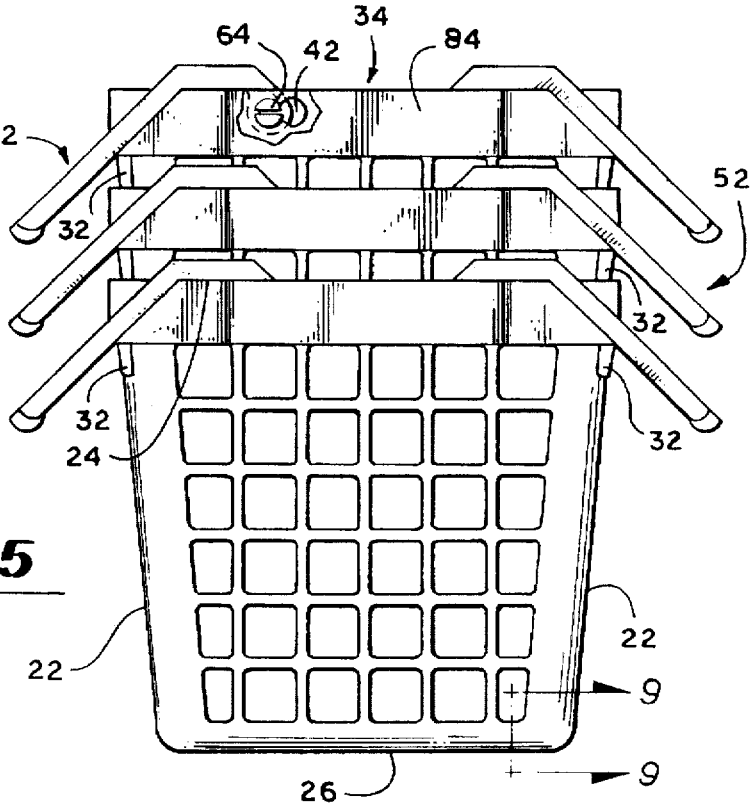
Fig_5

HAND CARRIED SHOPPING BASKET

BACKGROUND OF THE INVENTION

I. Field of the Invention

The present invention relates generally to the field of shopping containers. More particularly, the present invention relates to an ergonomically constructed, fatigue reducing shopping basket with a pair of handles that pivot outwardly from the basket walls to provide stackable storage.

II. Description of the Related Art

Occasionally, a shopper enters a store with a desire to purchase only a few items. Shopping baskets are generally provided by the stores for the convenience of shoppers to carry the items as they are gathered. Unfortunately, the conventional shopping baskets have the general configuration of the shopping basket illustrated in U.S. Design Pat. No. 326,552 by Goodell. This type of shopping basket has four sides extending upwardly from a bottom, a generally rectangularly-shaped opening and a pair of pivoting handles. Two of the sides are elongated and run parallel to the longitudinal axis and the other two sides run parallel to the lateral axis. The handles are pivotally mounted to the elongated sides proximate the opening such that one end of the handle is mounted to one elongated side and the opposite end of the handle is mounted to the other elongated side. Essentially, the handles meet and engage one another above and parallel to the lateral axis. The problem with this type of basket is that it forces the patron to carry the basket by the handle with the arm extended outwardly from the body with the palm of the hand facing fore or aft and parallel to the longitudinal axis. Because the arm is placed in an unnatural position with a load, stress is placed on the medial aspect of the elbow and the lateral shoulder and results in quick fatigue to the muscles of the arm, shoulder and back.

A folding carrier for bottles described in U.S. Pat. No. 2,844,279 by Kovach and a collapsible molded plastic carton described in U.S. Pat. No. 3,039,651 by Lang have a handle disposed along the longitudinal axis. However, the handle does not fold away from the longitudinal axis and due to the design of the sides is carried with the arm extended outwardly from the body in an unnatural position.

U.S. Pat. No. 4,941,586 by Tarna describes a container having an oblong shape so that it is ergonomically positioned favorably with respect to the carrying person. However, the handle is positioned along a lateral axis which causes the palm to face fore or aft in an unnatural position. Further, the container must be carried with the arm suspended outwardly from the body, causing the same stress and fatigue problems as the conventional shopping basket.

SUMMARY OF THE INVENTION

In accordance with the present invention and the contemplated problems which have and continue to exist in this field, the objectives of this invention are to provide an improved hand carried shopping basket which:

provides reduced fatigue from carrying;

enables a shopper's arm to hang closer to the body while carrying the shopping basket;

allows the palm of the hand to face naturally and in an anatomically-neutral position toward the body;

provides stackability of the shopping baskets;

has at least one longitudinal side with a concave shape;

provides a more comfortable handle structure to carry the shopping basket; and, provides essentially the same volume for items as conventional baskets.

This invention accomplishes the above and other objectives and overcomes the disadvantages of the prior art by providing an ergonomically improved hand carried shopping basket for a shopper that is simple in design and construction, inexpensive to fabricate, and easy to use. The basket is configured so that it essentially may be carried with the arm hanging closer to the body and the palm facing naturally and in an anatomically-neutral position toward the body, resulting in the shopper becoming fatigued less quickly. This invention has two lateral sides, two elongated, longitudinal sides and a bottom. All four sides are generally trapezoidally-shaped, and at least one of the longitudinal sides has a concave shape. Pivotally mounted to the lateral sides within a protrusion and aligned generally parallel to the longitudinal axis are a pair of spaced apart, elongated hand grips which combine and engage one another over the longitudinal axis. To facilitate stackability of the basket, the hand grips have angled pillars which enable each hand grip to be pivoted to an exterior position and provide open access to the bottom.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing the preferred embodiment of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein:

FIG. 3 is a top view of the hand carried shopping basket of FIG. 2;

FIG. 4 is a side elevation view of the hand carried shopping basket of FIG. 2;

FIG. 5 is a side elevation view of hand carried shopping baskets constructed in accordance with the present invention stacked one within another;

FIG. 6 is a partial, side view of the hand carried shopping basket illustrating a hand grip pivotally mounted within a port of the lateral side;

FIG. 7 is a side view of a post;

FIG. 8 is a front view of a post;

FIG. 9 is a section view taken along line 9—9 of FIG. 5 of the hand carried shopping basket illustrating a rail connected to a bottom surface;

DESCRIPTION OF THE PREFERRED EMBODIMENTS

Figure 1:
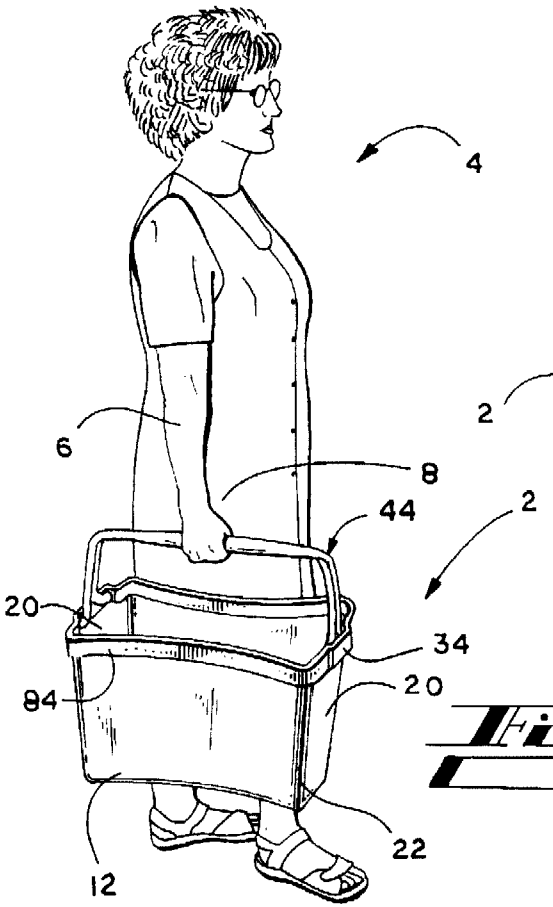
FIG. 1 is a perspective view of shopper with a hand carried shopping basket constructed in accordance with the present invention.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a hand carried shopping basket 2 constructed in accordance with the present invention being utilized by a shopper 4. As shown, the shopper 4 is capable of carrying the shopping basket 2 with the shopper's arm 6 hanging close to the shopper's body 8 with the palm facing naturally and in an anatomically-neutral position toward the body 8.

Figure 2:
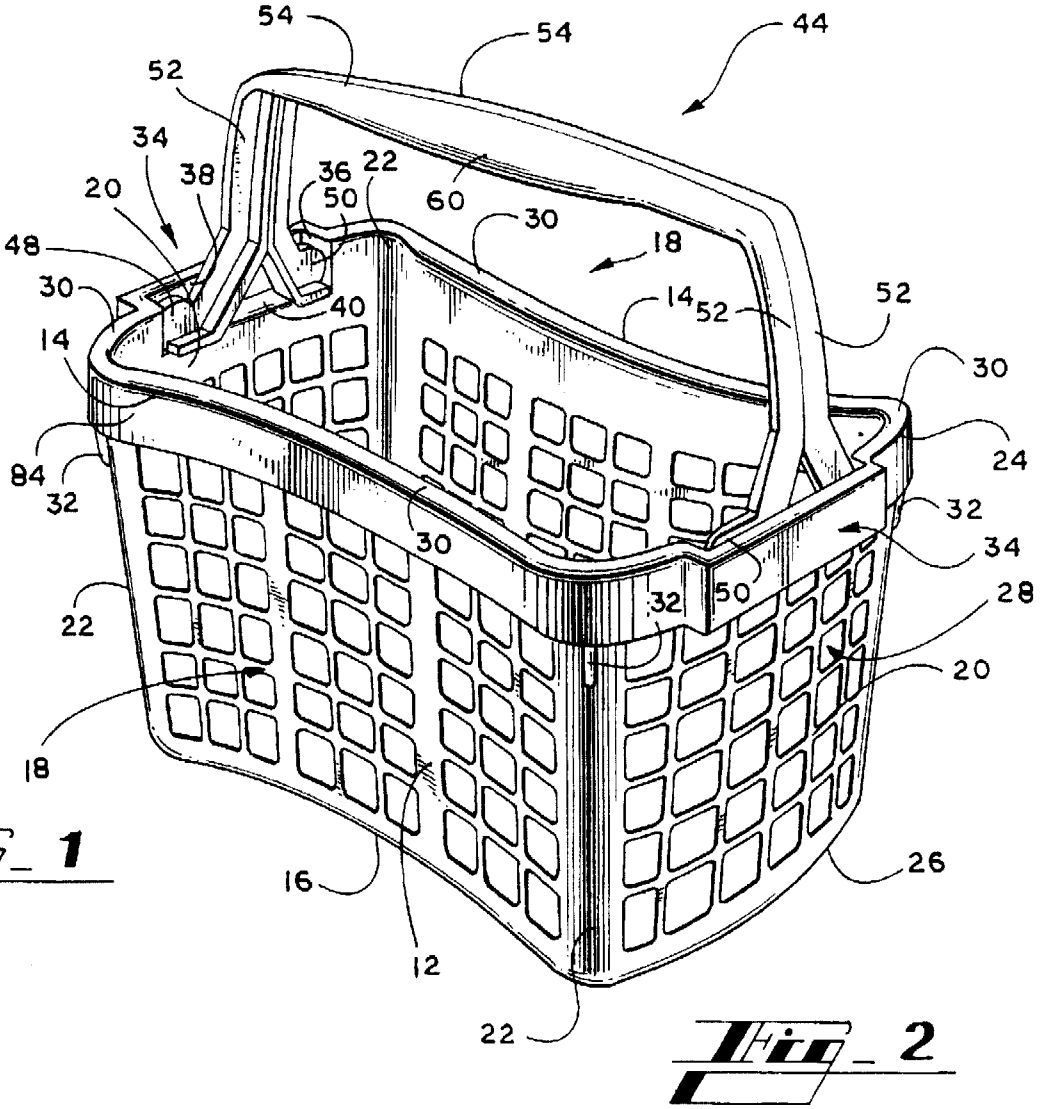
FIG. 2 is a perspective view of the hand carried shopping basket of FIG. 1 having webbed longitudinal and lateral sides.

Referring now additionally to FIGS. 2 through 4, the shopping basket 2 has a horizontal bottom 10, which has a central longitudinal axis running with the length of the bottom 10 and a central lateral axis running with the width of the bottom 10. Extending upwardly from the bottom 10 and generally parallel to the longitudinal axis are a pair of elongated longitudinal sides 12. At the upper most portion of each longitudinal side 12 is an upper longitudinal edge 14. Proximate the bottom 10 and substantially parallel to the upper longitudinal edge 14, the longitudinal side 12 has a lower longitudinal edge 16. Because the length of the upper longitudinal edge 14 is greater than the length of the lower longitudinal edge 16, the longitudinal side 12 has a first trapezoidal form, as best illustrated in FIG. 4. In this embodiment as particularly shown in FIG. 3, the upper and lower longitudinal edges 14 and 16 have inwardly projecting curvatures which cause the longitudinal sides 12 to have a concave shape 18.

A pair of lateral sides 20, which intersect and are connected to the longitudinal sides 12, extend upwardly from the bottom 10 and are generally parallel to the lateral axis. Each intersection between a given longitudinal side 12 and the adjacent lateral side 20 defines a corner 22. Preferably, the corners 22 are rounded. Similar to the structure of the longitudinal sides 12, at the upper most portion of each lateral side 20 is an upper lateral edge 24. Likewise, proximate the bottom 10 and substantially parallel to the upper lateral edge 24, the lateral side 20 has a lower lateral edge 26. The length of the upper lateral edge 24 is also greater than the length of the lower lateral edge 26 which results in, as illustrated in FIG. 5, the lateral side 20 having a second trapezoidal form. In the preferred embodiment, the upper lateral edge 24 and the lower lateral edge 26 project outward curvatures which cause the lateral sides 20 to have a convex shape 28. Around the upper portion of the shopping basket 2, the upper longitudinal and lateral edges 14 and 24 combine to form a rim 30.

Since the longitudinal and lateral sides 12 and 20 have trapezoidal forms, the shopping basket expands outwardly as the longitudinal and lateral sides 12 and 20 extend upwardly from the bottom 10 to the rim 30. In this embodiment, the cross-sectional area of the plane defined by the rim 30 is greater than the cross-sectional area of the bottom 10, resulting in the shopping baskets 2 being stackable, as shown in FIG. 5. To prevent the shopping basket 2 from becoming wedged within another shopping basket 2, the corner 22 has a stop 32 extending therefrom proximate the rim 30 to removably engage the rim 30 of the adjacent shopping basket 2 stacked below.

Centrally disposed along the longitudinal axis and in conjunction with the upper lateral edge 24 of each lateral side 20 is an outwardly extending protrusion 34. The protrusion 34 has a pair of protrusion side walls 36 extending from the lateral side 20, a protrusion mounting wall 38 disposed between the protrusion side walls 36 and a protrusion base wall 40 extending from the lateral side 20 and connected to the protrusion side and mounting walls 36 and 38 along the lower portions thereof. Extended through the mounting wall 38 are a pair of spaced apart key-shaped ports 42, as shown in FIG. 6. The ports 42 are equidistantly spaced from an imaginary center line that extends from the longitudinal axis and is perpendicular to the bottom 10.

To aide the shopper 4 in carrying the shopping basket 2, the shopping basket 2 has an elongated handle structure 44 which is connected to the lateral sides 20 and is aligned generally parallel to the longitudinal axis. The handle structure 44 comprises a pair of hand grips 46 that matingly and removably engage each other. Each hand grip 46 has a first grip end 48 and a second grip end 50. Originating from the first and second grip ends 48 and 50, each hand grip has a pair of pillars 52. An elongated beam 54 extends between and is generally perpendicular to the pillars 52. The beam 54 comprises a planar side 56 and a semicircular side opposite the planar side 56. As particularly shown in FIG. 6, the planar side 56 is substantially flat, and in use, the planar sides 56 face one another while the hand grips 46 matingly engage each other. Referring additionally to FIGS. 2 through 4, the semicircular side gradually increases in radius from the pillars 52 to an apex 60 proximate the center of the beam 54. Preferably, to improve stability of the hand grips 46 while matingly engaging one another, one of the planar sides 56 has at least one pin 62 extending outwardly therefrom and the other planar side 56 of the adjacent hand grip 46 has at least one bore (not shown) to matingly receive and removably engage the pin 62. Disposed proximate each of the first and second grip ends 48 and 50 is a post 64 to engage the ports 42 of the lateral sides 20 and pivotally mount the hand grips 46 within the protrusion 34. Referring to FIGS. 7 and 8, the post 64 has a stub 66 extending outwardly and generally perpendicularly from the pillar 52. A generally oval-shaped head 68 is disposed on the stub 66 and a slot 70 extends through the head 68 and stub 66 to form post halves 72 which resiliently flex as the post 64 is inserted into and pivotally mounted within the port 42.

As previously mentioned, the shopping baskets 2 are stackable. To promote stackability, the pillars 52 have a first section 74, a second section 76 and a third section 78. The intersection between the first and second sections 74 and 76 define a first bend 80 and the intersection between the second and third sections 74 and 76 define a second bend 82. In the preferred embodiment, the first and second bends 80 and 82 each form forty-five degree angles. Also, the first section 74 has a sufficient length to extend the second section 76 over the upper lateral edge 24 so that the first bend 80 engages the rim 30 when the hand grips 46 are pivoted away from each other. To prevent the post 64 from pinching the shopper 4 or engaging an article of clothing, the rim 30 has a rim wall 84 extending downwardly outside of the shopping basket 2 toward the bottom 10 to at least cover the port 42.

Referring now to FIG. 9, the bottom 10 preferably has a generally planar, raised bottom surface 86. To improve bottom 10 strength and reduce flexing of the bottom surface 86, the longitudinal and lateral sides 12 and 20 have respective rounded lower longitudinal and lateral edges 16 and 26 which are co-planar. In combination the rounded lower longitudinal and lateral edges 16 and 26 form a surface engaging rail 88 connected to and disposed below the bottom surface 86.

Figure 10:
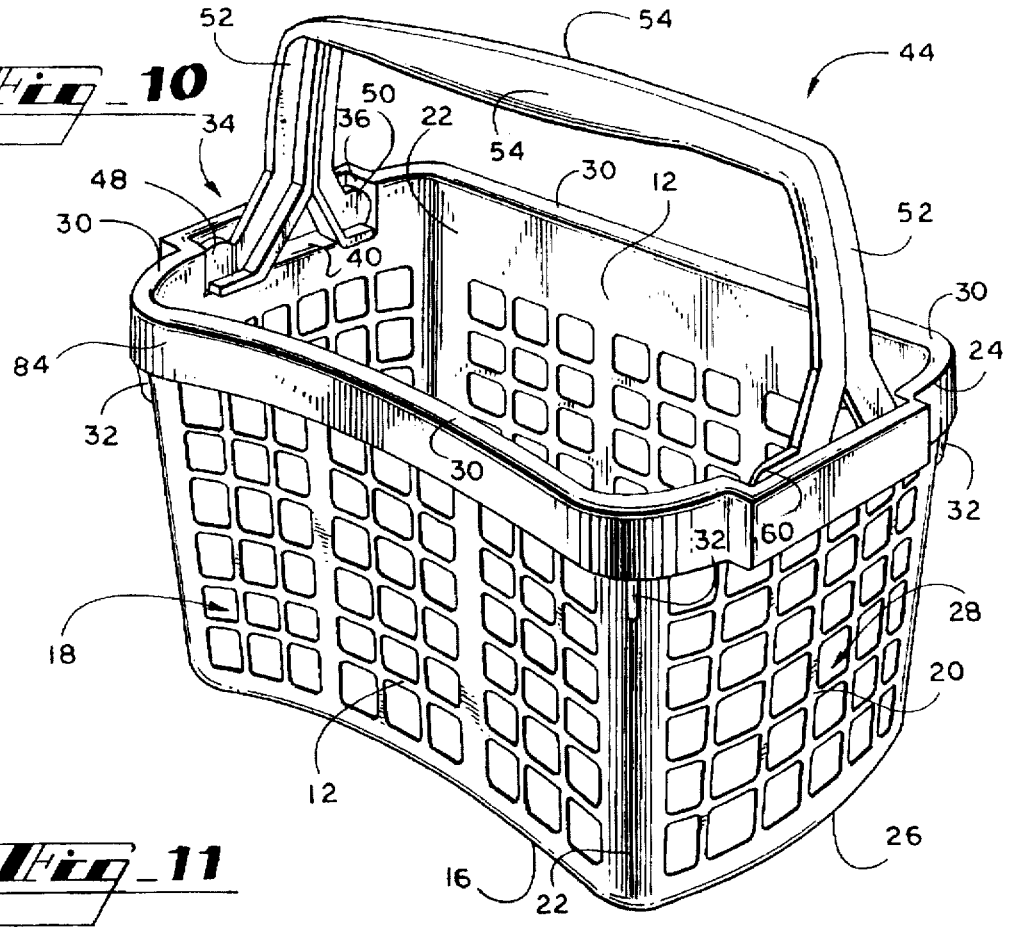
FIG. 10 is a perspective view of another embodiment constructed in accordance with the present invention.
Figure 11:
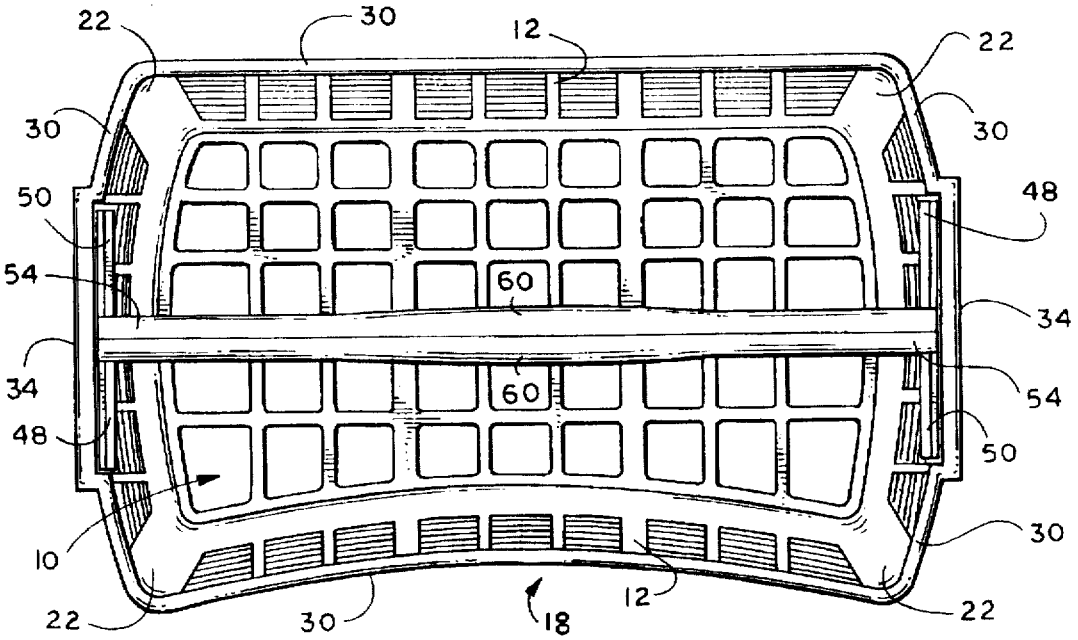
FIG. 11 is a top view of the embodiment of FIG. 10.

Another embodiment of the invention is shown in FIGS. 10 and 11. This embodiment has only one of the longitudinal sides 12 with the concave shape 18. In all other aspects of the features comprising the shopping basket 2, this embodiment is the same as the embodiment previously described. Additionally, both embodiments preferably have webbed longitudinal and lateral sides 12 and 20 and webbed bottom 10.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. An ergonomic hand carried shopping basket, comprising:

a bottom having a longitudinal axis and a lateral axis;

a pair of elongated longitudinal sides extending upwardly from the bottom and generally parallel to the longitudinal axis, both longitudinal sides having a generally concave shape, such that each side bows inwardly;

a pair of lateral sides extending upwardly from the bottom and generally parallel to the lateral axis, the lateral sides and the longitudinal sides intersecting and being connected to one another; and, an elongated handle structure connected to the lateral sides and being generally parallel to the longitudinal axis.

2. A shopping basket as claimed in claim 1, wherein the handle structure is pivotally mounted to the lateral sides.

3. A shopping basket as claimed in claim 1, wherein each lateral side has an upper lateral edge and a pair of spaced apart key-shaped ports disposed proximate each upper lateral edge, and the hand grips have a post disposed proximate both the first and second grip ends to engage one of the ports and pivotally mount the hand grips to the lateral sides, the post having a stub, a generally oval-shaped head disposed on the stub and a slot disposed through the head and stub to form post halves which resiliently flex toward each other as the post is pivotally mounted within the port.

4. A shopping basket as claimed in claim 3, wherein the longitudinal sides have an upper longitudinal edge, the lateral sides have an upper lateral edge, the upper longitudinal and lateral edges in combination form a rim, the rim has a rim wall extending downwardly outside of the shopping basket toward the bottom for a predetermined distance.

5. A shopping basket as claimed in claim 1, wherein the handle structure comprises a pair of hand grips matingly and removably engaging each other, each hand grip having a first grip end and a second grip end, and the first grip end being pivotally mounted to one lateral side and the second grip end being pivotally mounted to the other lateral side.

6. A shopping basket as claimed in claim 5, wherein the beam has a substantially planar side and a generally semicircular side opposite the planar side, the planar sides facing one another while the hand grips matingly engage each other, the semicircular side gradually increasing in radius from the pillars to an apex proximate the center of the beam.

7. A shopping basket as claimed in claim 6, wherein at least one planar side has at least one pin extending outwardly therefrom and the other planar side has at least one bore to matingly receive and removably engage the pin.

8. A shopping basket as claimed in claim 1, wherein each lateral side has an upper lateral edge and a protrusion proximate the upper lateral edge to receive the handle structure, and the handle structure comprises a pair of hand grips matingly and removably engaging each other, each hand grip having a first grip end and a second grip end, the first grip end being pivotally mounted to one lateral side within the protrusion and the second grip end being pivotally mounted to the other lateral side within the protrusion, each hand grip has pillars at the first and second grip ends and an elongated beam disposed between and generally perpendicular to the pillars, each pillar having at least a first section and a second section, the intersection between the first and second sections defining a bend, and the first section having a sufficient length to extend the second section over the upper lateral edge.

9. A shopping basket as claimed in claim 8, wherein the beam has a substantially planar side and a generally semicircular side opposite the planar side, the planar sides facing one another while the hand grips matingly engage each other, the semicircular side gradually increasing in radius from the pillars to an apex proximate the center of the beam.

10. A shopping basket as claimed in claim 8, wherein each lateral side has a pair of spaced apart key-shaped ports disposed proximate each upper lateral edge, and the hand grips have a post disposed proximate both the first and second grip ends to engage one of the ports and pivotally mount the hand grips to the lateral sides, the post having a stub, a generally oval-shaped head disposed on the stub and a slot disposed through the head and stub to form post halves which resiliently flex as the post is pivotally mounted within the port.

11. A shopping basket as claimed in claim 2, wherein each lateral side has an upper lateral edge and at least one key-shaped port disposed proximate the upper lateral edge, and the handle structure has ends and a post disposed proximate each end to engage the port and pivotally mount the handle structure to the lateral sides, the post having a stub, a generally oval-shaped head disposed on the stub and a slot disposed through the head and stub to form post halves which resiliently flex as the post is pivotally mounted within the port.

12. A shopping basket as claimed in claim 11, wherein the longitudinal sides have an upper longitudinal edge, the lateral sides have an upper lateral edge, the upper longitudinal and lateral edges in combination form a rim, the rim has a rim wall extending downwardly outside of the shopping basket toward the bottom for a predetermined distance.

13. A shopping basket as claimed in claim 1, wherein each intersection between the longitudinal side and the lateral side defines a corner and the corners are rounded.

14. A shopping basket as claimed in claim 1, wherein the longitudinal sides have an upper longitudinal edge, the lateral sides have an upper lateral edge, the upper longitudinal and lateral edges in combination form a rim, each intersection between a longitudinal side and adjacent lateral side defines a corner and the corner has an extending stop proximate the rim to removably engage the rim of an adjacent shopping basket aligned to be stacked below.

15. A shopping basket as claimed in claim 1, wherein the longitudinal side has upper and lower longitudinal edges, the lateral side has upper and lower lateral edges, the upper longitudinal edge is longer than the lower longitudinal edge and the upper lateral edge is longer than the lower lateral edge.

16. A shopping basket as claimed in claim 1, wherein the lateral sides are generally convexed-shaped.

17. A shopping basket as claimed in claim 1, wherein the bottom has a generally planar, raised bottom surface, each longitudinal side has a rounded lower longitudinal edge, each lateral side has a rounded lower lateral edge, the lower longitudinal and lateral edges are co-planar and in combination form a surface engaging rail connected to and disposed below the bottom surface.

18. A shopping basket as claimed in claim 1, wherein the bottom, the longitudinal sides and the lateral sides are webbed.

* * * * *